US006942463B2

(12) United States Patent
Ogolla et al.

(10) Patent No.: US 6,942,463 B2
(45) Date of Patent: Sep. 13, 2005

(54) COMBINATION WATER PUMP/AIR COMPRESSOR SYSTEM

(76) Inventors: Beneah T. Ogolla, 7705 Covedale Dr., Orlando, FL (US) 32818; Gregory T. Lee, 7705 Covedale Dr., Orlando, FL (US) 32818

( * ) Notice: Subject to any disclaimer, the term of this patent is extended or adjusted under 35 U.S.C. 154(b) by 259 days.

(21) Appl. No.: 10/405,282

(22) Filed: Apr. 3, 2003

(65) Prior Publication Data

US 2004/0197195 A1 Oct. 7, 2004

(51) Int. Cl.[7] ..... F04B 23/08; F04F 5/04
(52) U.S. Cl. ..... 417/77; 417/80
(58) Field of Search ..... 60/325, 453; 417/76, 417/77, 79, 80

(56) References Cited

U.S. PATENT DOCUMENTS 1,855,061 A * 4/1932 Lauchenauer ..... 417/80
2,452,421 A * 10/1948 Ames ..... 417/77
2,702,664 A * 2/1955 Pienaar ..... 417/77
3,367,269 A * 2/1968 Nelson et al. ..... 417/80
3,895,885 A * 7/1975 Liberg ..... 417/54
4,478,553 A 10/1984 Leibowitz et al.
4,522,151 A 6/1985 Arbisi et al.
4,704,070 A * 11/1987 Iseman ..... 417/80
4,767,281 A * 8/1988 Sailer ..... 417/83
4,797,563 A 1/1989 Richardson
D325,387 S 4/1992 Rupe
5,302,300 A 4/1994 Porri
5,537,813 A 7/1996 Davis et al.
6,225,706 B1 5/2001 Keller
6,302,655 B1 * 10/2001 Popov ..... 417/77
6,334,758 B1 * 1/2002 Popov ..... 417/77

* cited by examiner

*Primary Examiner*—Michael Koczo, Jr.

(57) ABSTRACT

A combination water pump/air compressor system for performing two separate functions with one unit by providing compressed air and water. The combination water pump/air compressor system includes a piping configuration including a main pipe capable of carrying a combined compressed air and water, and also including valve members being connected to the main pipe; and also including a water and air pressure accumulator assembly being connected to one of the valve members and being adapted to be connected to water and air sources for providing compressed water to the main pipe; and further includes an air injector being connected to the main pipe for creating air bubbles in the water in the main pipe; and also includes a water and air mixer assembly being connected to the main pipe for pressurizing the spongy liquid/gas mixture; and further includes a water and air separator assembly also being connected to the main pipe for separating compressed air from compressed water.

6 Claims, 4 Drawing Sheets

COMBINATION WATER PUMP/AIR COMPRESSOR SYSTEM

BACKGROUND OF THE INVENTION

1. Field of the Invention

The present invention relates to combination water pumps/air compressors and more particularly pertains to a new combination water pump/air compressor system for performing two separate functions with one unit by providing compressed air and water.

2. Description of the Prior Art

The use of combination water pumps/air compressors is known in the prior art. More specifically, combination water pumps/air compressors heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,225,706; U.S. Pat. No. 4,478,553; U.S. Pat. No. 4,797,563; U.S. Pat. No. 5,537,813; U.S. Pat. No. 4,522,151; and U.S. Pat. No. Des. 325,387.

While these devices fulfill their respective, particular objectives and requirements, the aforementioned patents do not disclose a new combination water pump/air compressor system. The prior art includes turbines used for driving air and water for creating power.

SUMMARY OF THE INVENTION

The general purpose of the present invention, which will be described subsequently in greater detail, is to provide a new combination water pump/air compressor system which has many of the advantages of the combination water pumps/air compressors mentioned heretofore and many novel features that result in a new combination water pump/air compressor system which is not anticipated, rendered obvious, suggested, or even implied by any of the prior art combination water pumps/air compressors, either alone or in any combination thereof. The present invention includes a piping configuration including a main pipe capable of carrying a combined compressed air and water, and also including valve members being connected to the main pipe; and also including a water and air pressure accumulator assembly being connected to one of the valve members and being adapted to be connected to water and air sources for providing pressurized water to the main pipe; and further includes an air injector being connected to the main pipe for creating air bubbles in the water in the main pipe; and also includes a water and air mixer assembly being connected to the main pipe for pressurizing the spongy liquid/gas mixture; and further includes a water and air separator assembly also being connected to the main pipe for separating compressed air from compressed water. None of the prior art includes the combination of the elements of the present invention.

There has thus been outlined, rather broadly, the more important features of the combination water pump/air compressor system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new combination water pump/air compressor system which has many of the advantages of the combination water pumps/air compressors mentioned heretofore and many novel features that result in a new combination water pump/air compressor system which is not anticipated, rendered obvious, suggested, or even implied by any of the prior art combination water pumps/air compressors, either alone or in any combination thereof.

Still another object of the present invention is to provide a new combination water pump/air compressor system for performing two separate functions with one unit by providing compressed air and water.

Still yet another object of the present invention is to provide a new combination water pump/air compressor system that requires the use of little power by utilizing isothermal compression and low torque.

Even still another object of the present invention is to provide a new combination water pump/air compressor system that increases the efficiency and performance of turbines and turbo chargers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
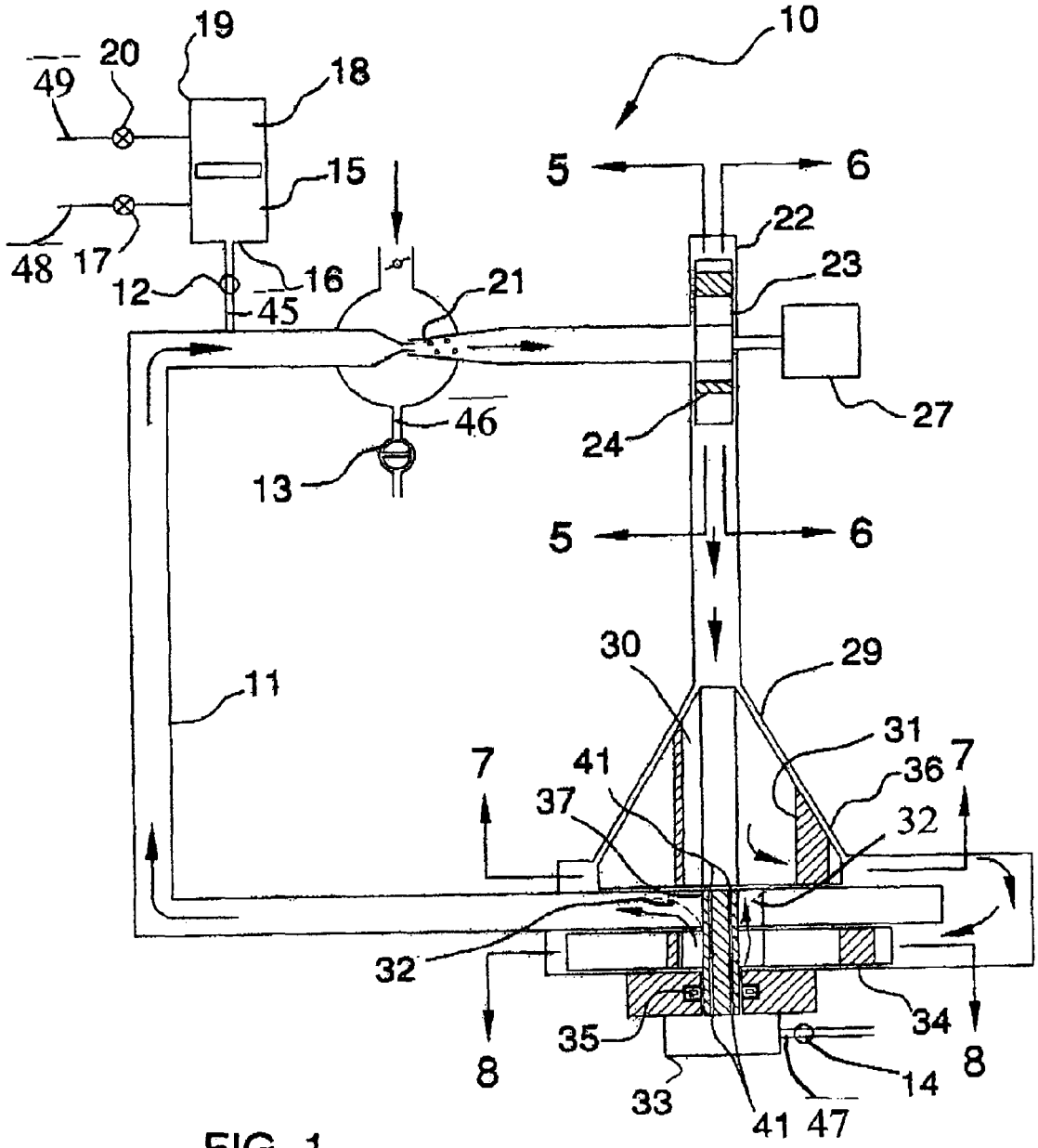
FIG. 1 is a side elevational view of the piping configuration of a new combination water pump/air compressor system according to the present invention.

With reference now to the drawings, and in particular to FIGS. 1 through 8 thereof, a new combination water pump/air compressor system embodying the principles and concepts of the present invention and generally designated by the reference numeral 10 will be described.

As best illustrated in FIGS. 1 through 8, the combination water pump/air compressor system 10 generally comprises a piping configuration including a main pipe 11 capable of carrying combined pressurized air and water, and also including first, second and third extension pipes 45–47 being securely and conventionally connected to the main pipe 11, and further including valve members 12–14 being connected to the extension pipes 45–47. The valve members 12–14 include a water intake valve 12 being securely attached to the first extension pipe 45, and also include a water drainage valve 13 being securely attached to the second extension pipe 46, and further include an air outlet valve 14 being securely attached to the third extension pipe 47.

A water and air pressure accumulator assembly is securely connected to one of the valve members 12–14 and is adapted to be connected to water and air sources for providing pressurized water to the main pipe 11. The water and air pressure accumulator assembly includes a water pressure accumulator 15 having a water reservoir 16 for receiving water from the water source and also having a water valve 17 being securely connected to a water pipe 48 which is conventionally connected to the water pressure accumulator 15 which is conventionally connected to the first extension pipe 45 for introducing water into the main pipe 11 through the first extension pipe, and also includes an air pressure accumulator 18 having an air tank 19 for collecting air from the air source and also having an air valve 20 being securely connected to an air line 49 which is conventionally connected to the air tank 19. The air pressure accumulator 18 is conventionally connected to the water pressure accumulator 15 for pressurizing water received in the water pressure accumulator 15.

An air injector 21 is securely connected to the main pipe 11 for creating air bubbles in the water in the main pipe 11. The air injector 21 is a venturi being securely disposed inline of the main pipe 11 for creating a suction which draws in ambient air into the main pipe 11 thus creating air bubbles in the water in the main pipe 11.

A water and air mixer assembly is securely connected to the main pipe 11 for pressurizing the spongy liquid/gas mixture. The water and air mixer assembly includes an impeller housing 22 being securely connected to the main pipe 11, and also includes a water impeller 23 being securely disposed in the impeller housing 22 and having radial-extended vanes 24 for driving the water in the main pipe 11, and further includes an air impeller 25 having radial-extended vanes 26 for driving the air bubbles in the main pipe 11 with the water and air impellers 23,25 being mounted back-to-back, and also includes an impeller motor 27 being securely connected to the water impeller 23 and to the air impeller 25 for the energizing thereof, and further includes air bleed holes 28 being disposed through a wall of the water impeller 23 and interconnecting the air and water impellers 23,25 for bleeding the air disposed therein and for facilitating the separation of the water and air at a center of the water and air impellers 23,25 with the air and water again being mixed at a periphery of the air and water impellers 23,25. The water impeller 23 and the air impeller 25, in combination, mix and pressure the air and the water together.

A water and air separator assembly is also securely connected to the main pipe 11 for separating pressurized air from pressurized water. The water and air separator assembly includes a water/air centrifuge 30 having vane members 31 for separating the air from the water, and further includes guide ducts 32 which are bell-shaped for directing the water 90 degrees into the main pipe 11, and also includes an air holding tank 33 being securely connected to the water/air centrifuge 30 for receiving the pressurized separated-out air created by the water/air centrifuge 30, and further includes a water turbine 34 being securely connected to the main pipe 11 and having radial-extended vanes for regenerating and re-circulating the water through the main pipe 11 by energizing the water/air centrifuge 30. The water/air centrifuge 30 has O-ring seal members 35 and an elongate duct 36 for slowing down the mixture of water and air to ensure proper centrifugal action upon the water and air mixture. The guide ducts 32 are conventionally disposed between the water/air centrifuge 30 and the water turbine 34 as shown by the dotted lines in FIG. 1.

Figure 4:
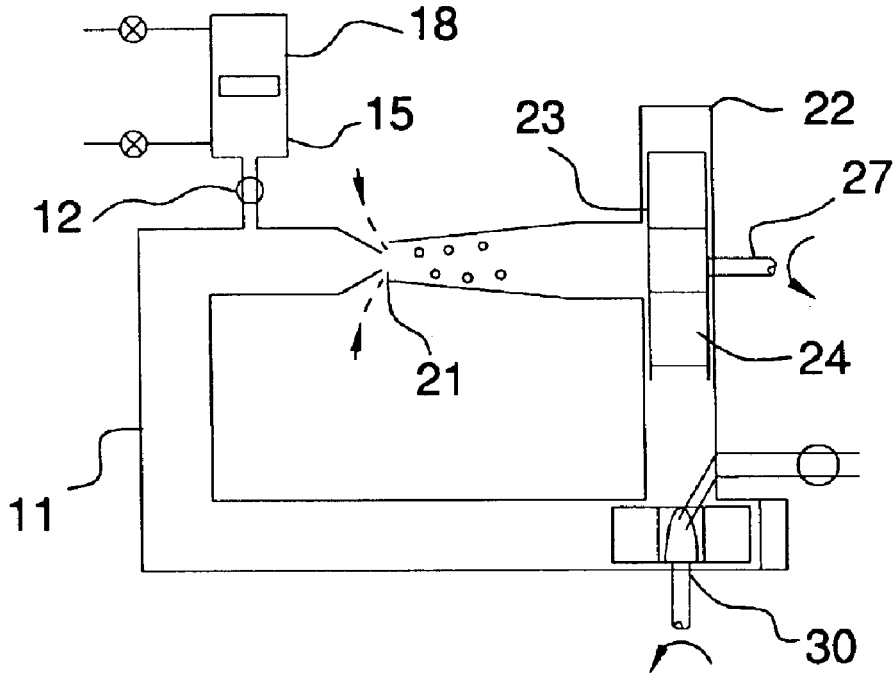
FIG. 4 is a side elevational view of another embodiment of the present invention.
Figure 2:
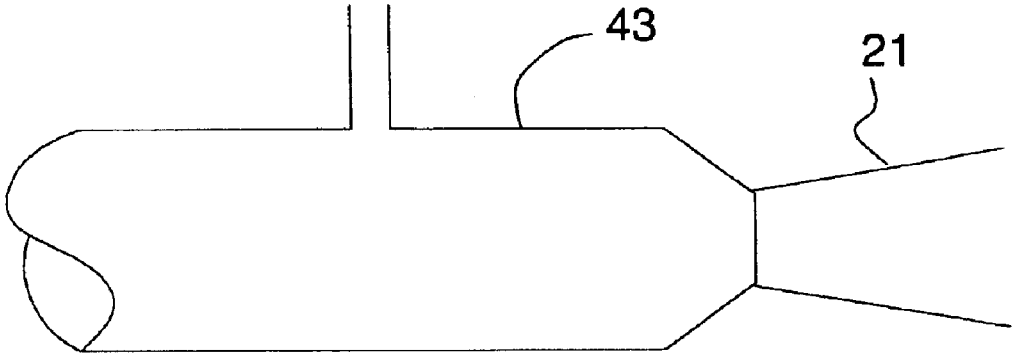
FIG. 2 is a side elevational view of a jet and venturi assembly (injector) with a connection to a base pressure accumulator of the present invention.
Figure 3:
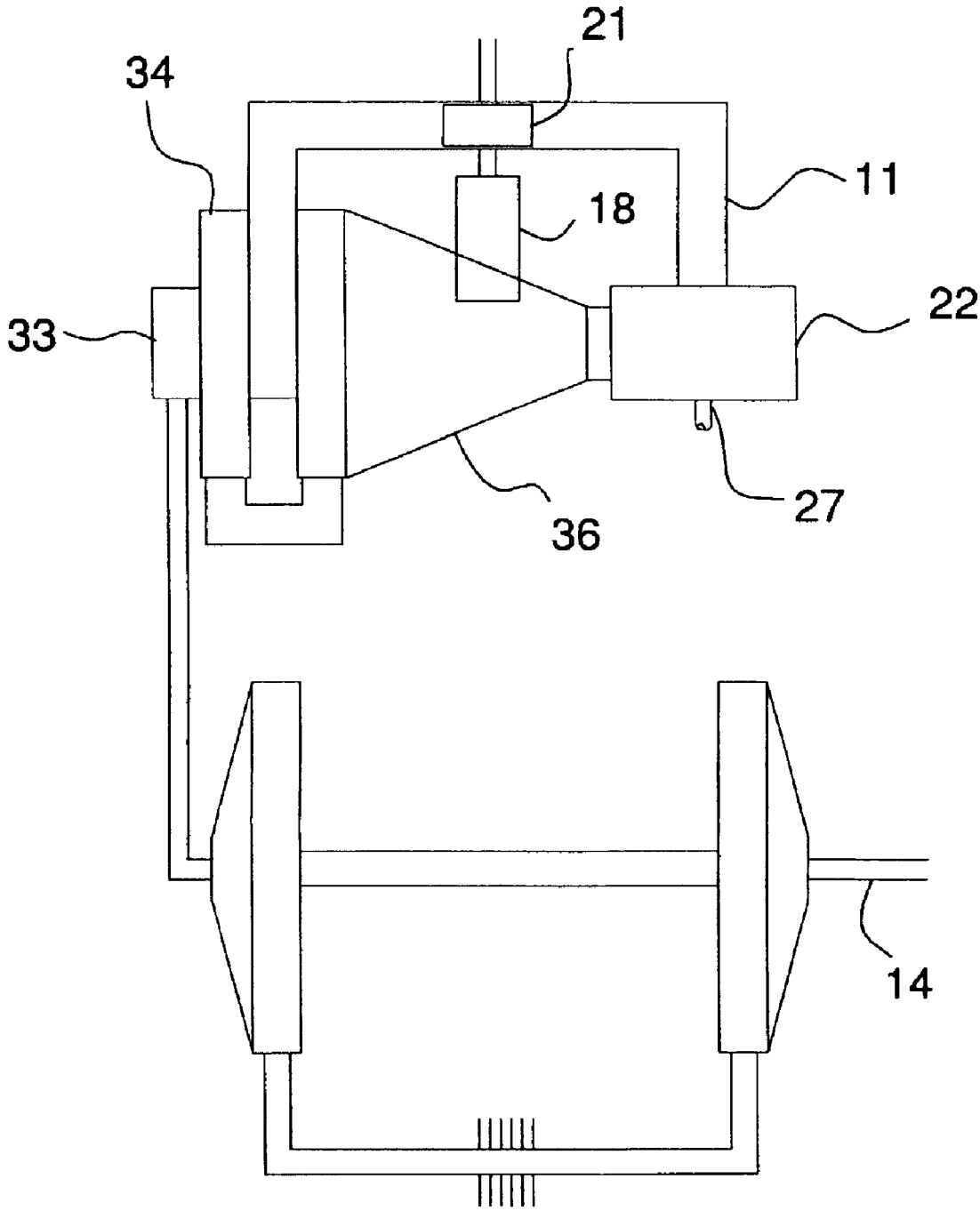
FIG. 3 is a side elevational view of present invention being connected to a cold air unit for air conditioning.
Figure 5:
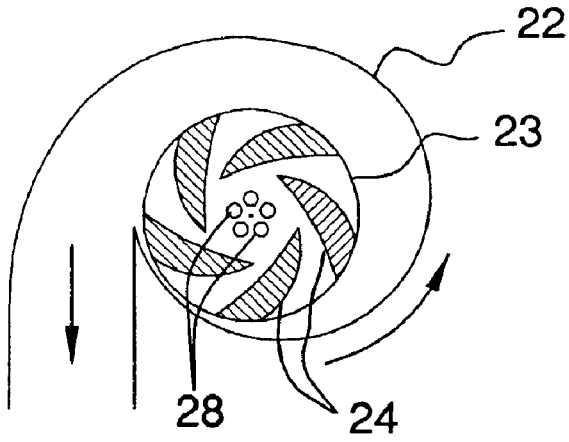
FIG. 5 is a cross-sectional view of a water impeller of the present invention.
Figure 6:
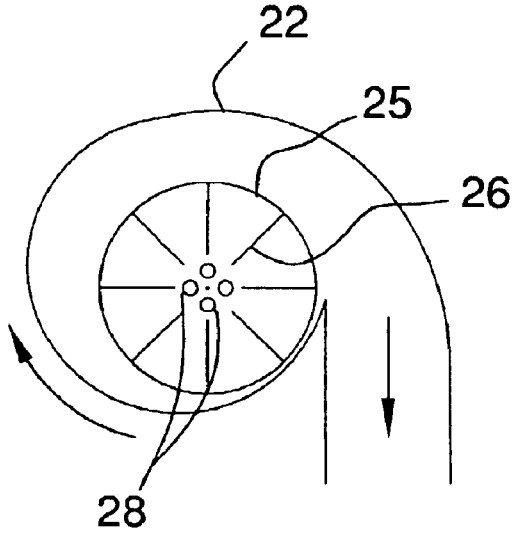
FIG. 6 is a cross-sectional view of an air impeller of the present invention.
Figure 7:
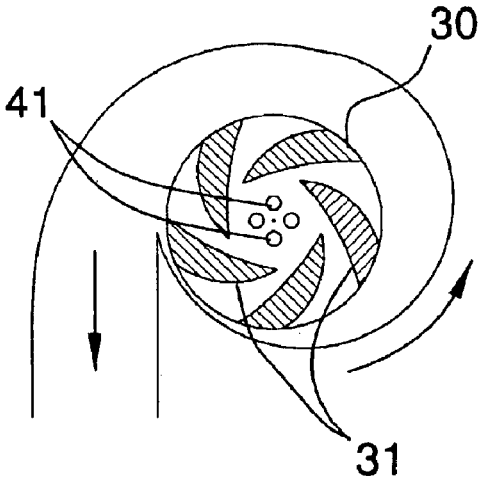
FIG. 7 is a cross-sectional view of a water/air separator of the present invention.
Figure 8:
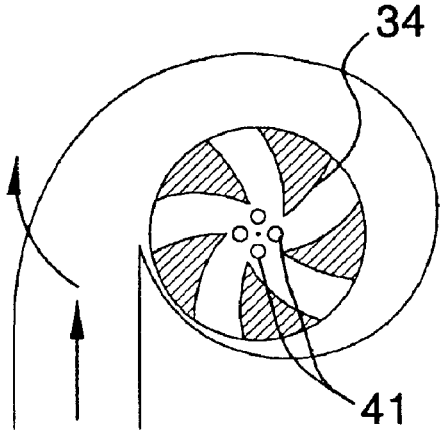
FIG. 8 is a cross-sectional view of an energy regenerating turbine of the present invention.

In FIG. 4, another embodiment includes separated air being tapped from the front of the water/air centrifuge 30 rather than being bled through air bleed holes 41 disposed in a ported hub assembly 37 to the air holding tank 33.

In use, the water and air are introduced into the main pipe 11 through the first extension pipe which is connected to the water and air pressure accumulator assembly, and the venturi 21 creates air bubbles in the water in the main pipe 11, and the water and air impellers 23,25 pressurizes the air and water together to form a spongy liquid/gas mixture which is then passed onto the water/air centrifuge 30 which separates the air from the water with the water being re-circulated back through the main pipe 11, and the air is stored in an air holding tank 33 for use by the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the combination water pump/air compressor system. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A combination water pump/air compressor system comprising:

a piping configuration including a main pipe carrying a combined pressurized air and water, and also including first, second and third extension pipes which are connected to said main pipe, and further including valve members being connected to said extension pipes;

a water and air pressure accumulator assembly being connected to said first extension pipe and being adapted to be connected to water and air sources for providing pressurized air and water to said main pipe;

an air injector being connected to said main pipe for creating air bubbles in the water in said main pipe;

a water and air mixer assembly being disposed downstream from said air injector and being connected to said main pipe for pressurizing a spongy liquid/gas mixture; and a water and air separator assembly also being disposed downstream from said water and air mixer and being connected to said main pipe for separating pressurized air from pressurized water.

2. The combination water pump/air compressor system as described in claim 1, wherein said valve members include a water intake valve being attached to said first extension pipe, and also include a water drainage valve being attached to said second extension pipe, and further include an air outlet valve being attached to said third extension pipe.

3. The combination water pump/air compressor system as described in claim 2, wherein said water and air pressure accumulator assembly includes a water pressure accumulator having a water reservoir for receiving water from the water source and also having a water valve being connected to a water pipe which is conventionally connected to said water pressure accumulator, and also includes an air pressure accumulator having an air tank for collecting air from the air source and also having an air valve being connected to an air line which is connected to said air tank, said water pressure accumulator being connected to said first extension pipe and said air pressure accumulator being connected to said water pressure accumulator.

4. The combination water pump/air compressor system as described in claim 3, wherein said air injector is a venturi being disposed inline of said main pipe for creating a suction which draws in ambient air into said main pipe thus creating air bubbles in the water in said main pipe.

5. The combination water pump/air compressor system as described in claim 4, wherein said water and air mixer assembly includes an impeller housing being connected to said main pipe, and also includes a water impeller being disposed in said impeller housing and having radial-extended vanes for driving said water in said main pipe and further includes an air impeller having radial-extended vanes for driving the air bubbles in said main pipe, and also includes an impeller motor being connected to said water impeller and to said air impeller for the energizing thereof, and further includes holes being disposed through a wall of said water impeller for bleeding the air disposed therein, said water impeller and said air impeller, in combination, mixing and pressurizing said air and said water together.

6. The combination water pump/air compressor system as described in claim 5, wherein said water and air separator assembly is connected to said main pipe, and also includes a water/air centrifuge having vane members for separating the air from the water, and further includes guide ducts which are bell-shaped for directing the water into said main pipe, and also includes an air holding tank being connected to said water/air centrifuge for receiving the pressurized separated-out air created by said water/air centrifuge, and further includes a water turbine being connected to said main pipe and having radial-extended vanes for regenerating and re-circulating the water through said main pipe, said water/air centrifuge having O-ring seal members and an elongate duct for slowing down the mixture of water and air to ensure proper centrifugal action upon the water and air mixture, said guide ducts being disposed between said water/air centrifuge and said water turbine.

* * * * *